United States Patent [19]

Bourque

[11] Patent Number: 4,509,276

[45] Date of Patent: Apr. 9, 1985

[54] COMPOSITE SKATE BOOT AND METHOD OF MAKING THE SAME

[75] Inventor: Rene Bourque, Duvernay, Canada

[73] Assignee: Warrington Inc., Montreal, Canada

[21] Appl. No.: 462,118

[22] Filed: Jan. 28, 1983

[51] Int. Cl.[3] ..... A43B 5/16

[52] U.S. Cl. ..... 36/115; 12/142 R

[58] Field of Search ..... 36/115, 117, 118, 119, 36/116, 120; 264/244; 12/142 R

[56] References Cited

U.S. PATENT DOCUMENTS

| | | | |
|---|---|---|---|
| 3,235,978 | 2/1966 | Hyde | 36/115 |
| 3,849,914 | 11/1974 | Bertele | 36/119 |
| 3,861,067 | 1/1975 | Koyama et al. | 36/120 |
| 3,939,583 | 2/1976 | Daumann | 36/115 |
| 4,107,856 | 8/1978 | Bourque | 36/115 |
| 4,351,537 | 9/1982 | Seidel | 36/115 |
| 4,384,413 | 5/1983 | Bourque | 36/115 |
| 4,385,456 | 5/1983 | Livernois | 36/115 |

FOREIGN PATENT DOCUMENTS

| | | | |
|---|---|---|---|
| 1066500 | 11/1979 | Canada | 36/115 |
| 1066501 | 11/1979 | Canada | 36/115 |
| 2825319 | 1/1979 | Fed. Rep. of Germany | 36/117 |
| 2371895 | 7/1978 | France | 36/120 |

*Primary Examiner*—Henry S. Jaudon
*Assistant Examiner*—Mary A. Elis
*Attorney, Agent, or Firm*—Schwartz, Jeffery, Schwaab, Mack, Blumenthal & Koch

[57] ABSTRACT

A skate boot comprises a lower, upper and an intermediate portion between the lower and the upper. The lower includes a sole, toe and heel portions made of a molded unitary rigid plastics material. The intermediate portion is connected to the lower and includes ankle and Achilles tendon portions of the boot and is made of a relatively flexible material. The upper including the eyelet bands and the upper tendon guard are made of a pliable material. The construction allows forward flexure and torsional flexibility in the ankle area, foot forming moldability in the upper area of the boot and impact resistant rigidity in the lower.

12 Claims, 10 Drawing Figures

90
86
22
88
16
20
38
18
14
12
102
46
10
80
104
106
84
82

104
80
84
10
102
106
14
84
82
18
16

6
90
86
7
22
10
46
62
84
82
20
16
38
7
8
8
18
6
14
12

52
86
46
86
22
88
20
44
31
28
18
14
26
24
30
32
50
36
34
58
82
102
104
116
117

68
68
86
88
62
44
31
73
28
73
29
24
38
84
82
70
110
108
73

COMPOSITE SKATE BOOT AND METHOD OF MAKING THE SAME

BACKGROUND OF THE INVENTION

1. Field of the Invention

The present invention relates to a skate boot and particularly to a skate boot of the type used for ice hockey.

2. Description of the Prior Art

Hockey skate boots, presently, can be classified either as a molded skate boot, if the boot includes a molded plastics shell with an inner slipper or a leather boot if the skate boot is manufactured, using a last, with different materials including leather, nylon, fabric and fibre material inlays.

The molded plastic skate boot is usually molded in a two-part shell, including a lower and an upper pivotally mounted to the lower.

A separate slipper made of foam or the like material is provided within the shells adapted to form itself to the foot of the wearer. However, the skate is not fully responsive to the thrusts of the foot since some of the force being transferred to the foot laterally, or torquewise, is being lost due to movement of the slipper relative to the plastic molded shell. This power loss is especially noticeable in high performance skates utilized by professional hockey players.

Furthermore, it has been observed that when the laces are being tightened to close the skate on one's foot, the distribution of the pulling forces caused by the laces tends to be equally distributed along the sidewalls of the lower where in fact it is preferable to have varying tension forces along different parts of the sidewalls. Although the slipper gets molded to the foot, the plastic shell does not in the light of its inherent rigidity. Furthermore, there is very little lateral flexibility in the area of the ankle. In power skating, acceleration is affected by the degree of flexibility in the ankle area of the boot.

Leather skates on the other hand require the use of a last and considerable, skilled, hand labor to construct. The cost of the material is high as well as the resultant labor. Although a leather skate boot has the advantage of molding itself to the foot, providing flexibility where necessary, it has a tendency to "break" or lose its strength in the ankle area and the area of the Achilles tendon. Leather breathes well, but it also wears more easily.

SUMMARY OF THE INVENTION

It is an aim of the present invention to provide an improved skate boot incorporating the advantage of both the molded plastic skate boot and the conventional leather skate boot.

It is a further aim of the present invention to provide a composite hockey skate boot having a rigid molded plastics lower with an upper of relatively flexible material especially in the area of the ankle, the upper being integrally attached to the lower.

A construction in accordance with the present invention comprises a skate boot including a lower and upper and an intermediate portion between the lower and the upper; the lower including a sole, toe and heel portions of the boot and being made of a molded, unitary, rigid plastics material; the intermediate portion being connected to the lower and including ankle and Achilles tendon portions of the boot and being made of a relatively flexible material and the upper including the eyelet bands and upper tendon guard and being made of a pliable material.

A more specific construction according to the present invention comprises a skate boot having a lower, an ankle portion and an upper. The lower is made of a unitary molded rigid plastics material defining a sole, an enclosed toe zone, a metatarsal zone and a heel zone. The ankle portion includes a unitary member of relatively flexible material adapted to extend over the ankle protrusions and part of the Achilles tendon of the wearer and is attached to the lower.

The upper is made of leather or the like material and defines a guard covering the upper portion of the Achilles tendon and an eyelet band on either side of a corresponding opening in the lower. The upper being attached to the ankle portion and lower respectively, an interior liner within the boot is attached at least to the ankle portion and the upper such that the skate is provided with improved rigidity and wear resistance in the lower, combined with lateral flexibility in the ankle area and foot forming moldability in the eyelet bands and upper. The upper including the eyelet bands, thus conforms to various metatarsal shapes.

A method of forming a skate boot in accordance with the present invention comprises the steps of molding from plastics material a lower of unitary construction defining the sole, toe, metatarses and heel of a boot and provided with an upstanding continuous edge defining in part an opening for receiving eyelet bands and an ankle portion; molding an ankle portion of relatively flexible plastics material, forming an upper of pliable material, fixing the upper including the eyelet bands to the respective edges of the lower and the exposed edges of the ankle portion; forming an inner liner and fitting the inner liner to the interior of the upper and ankle portion, fixing a lower edge of said ankle portion, at least in the area of the ankle protrusions of a wearer, to the side parts of the upstanding edge of the lower; and fixing the inner liner to at least the upper and lower portions.

In a still more specific construction in accordance with the present invention there is provided a strech resistant fabric sheet connected to the upper and the lower and coextensive with the sides of the intermediate or ankle portion thereby to allow the lateral flexibility of the intermediate portion but to resist against lateral elongation of the intermediate portion.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
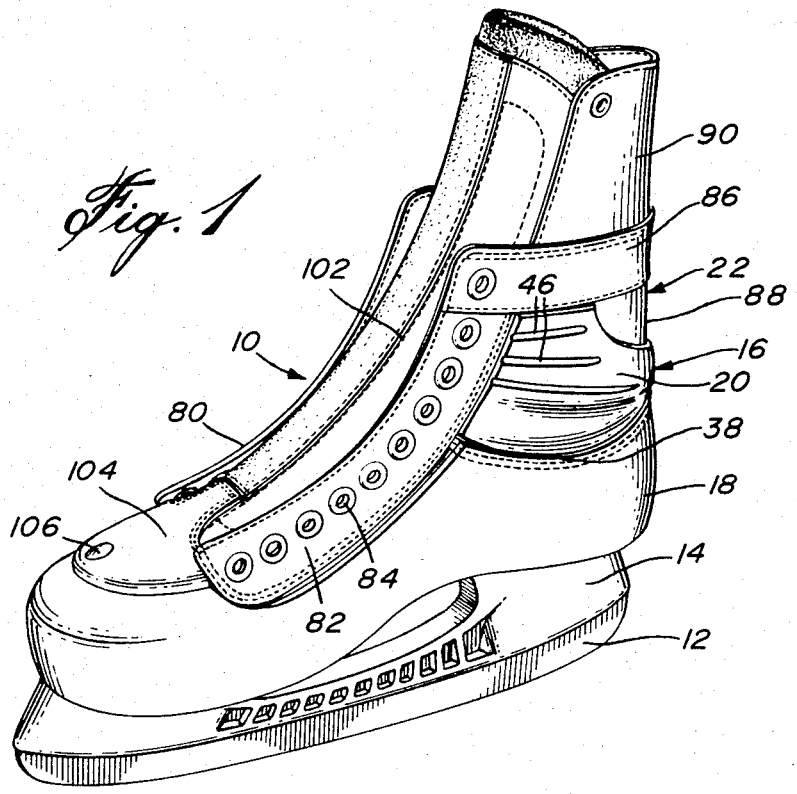
FIG. 1 is a perspective view of a skate boot in accordance with the present invention.
Figure 2:
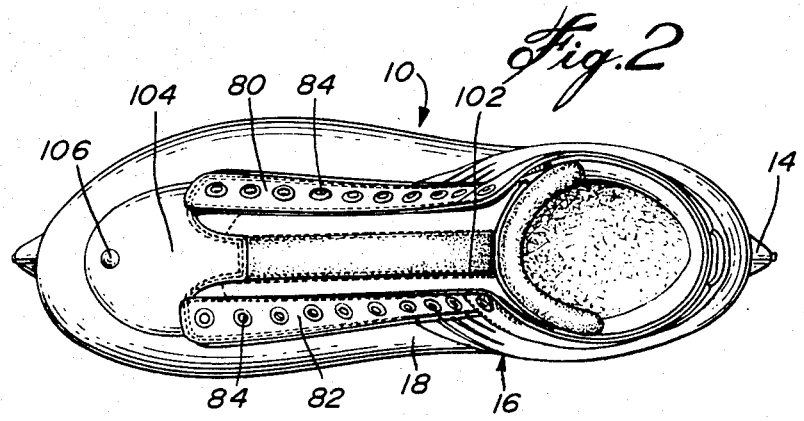
FIG. 2 is a top plan view thereof.
Figure 3:
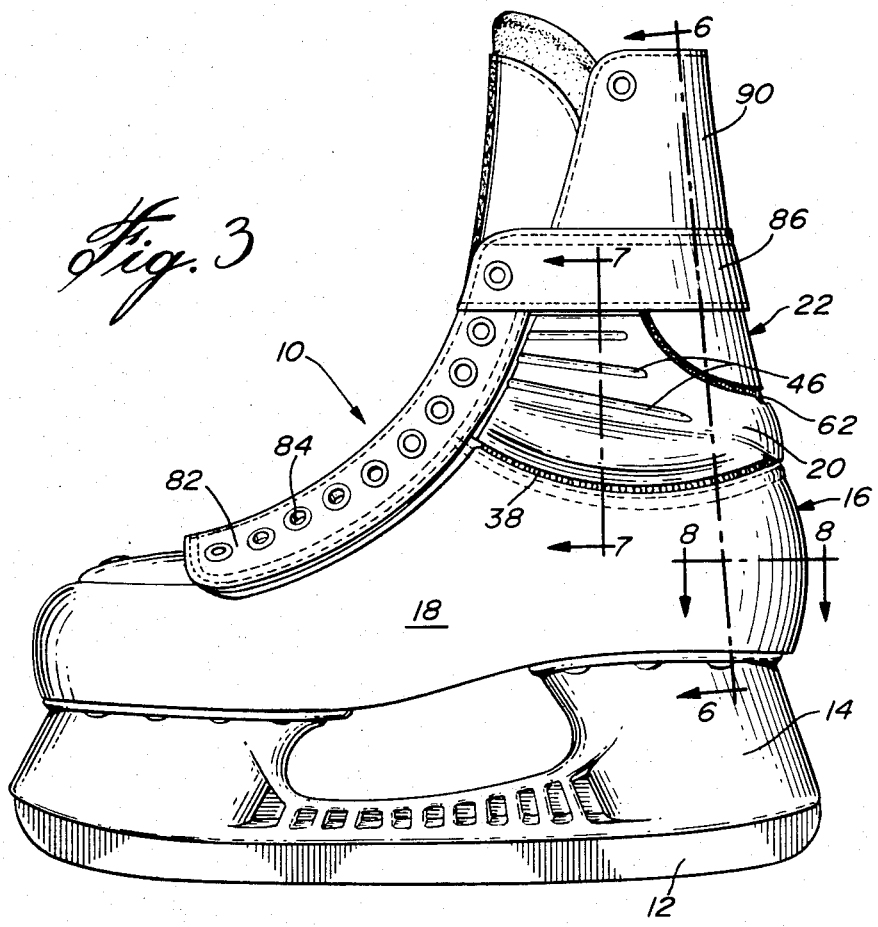
FIG. 3 is a side elevation of the skate boot shown in FIG. 1.

Referring now to the drawings, a hockey skate 10 is illustrated in FIGS. 1 to 3 and 9 and 10 having a boot 16 to which is mounted a blade support 14 and a skate blade 12. The blade support 14 is of the molded plastics type, that is a steel blade 12 is inserted into a mold cavity while a plastic material is formed in the cavity. Of course, any other type of conventional blade can be utilized with the boot of the present construction.

Figure 4:
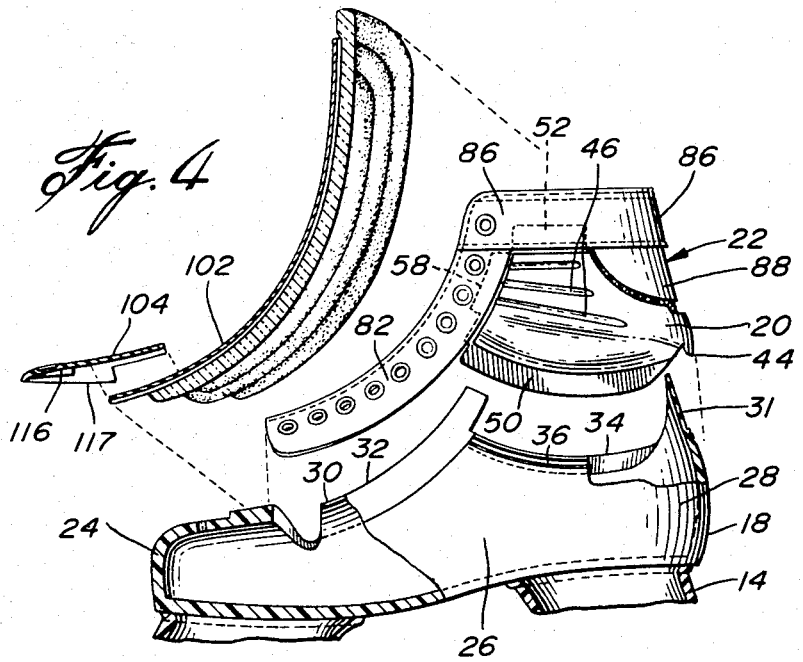
FIG. 4 is an exploded view of the skate boot partly in cross-section shown from a side elevation thereof.
Figure 5:
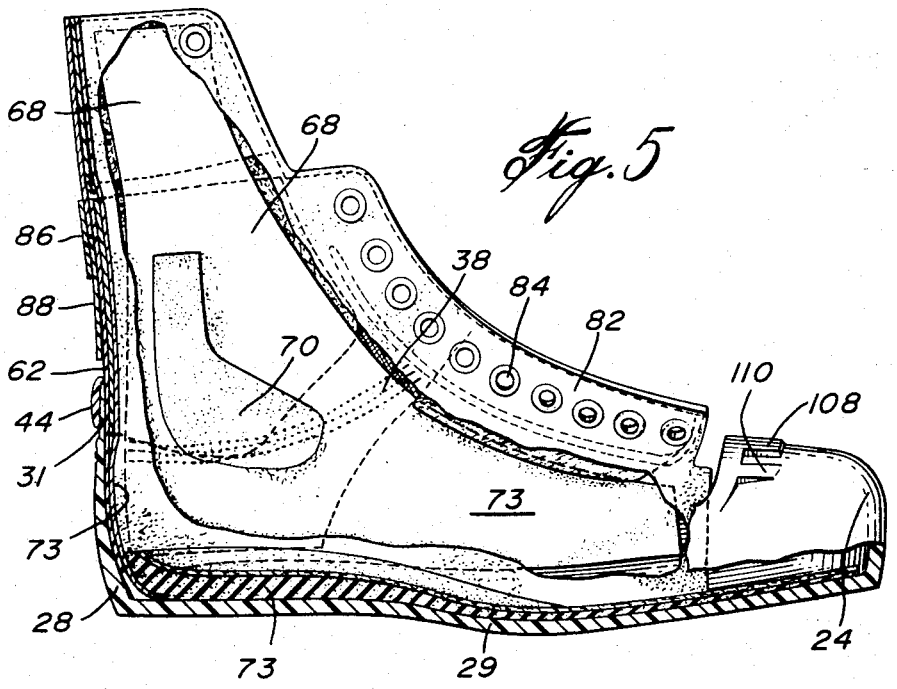
FIG. 5 is an enlarged fragmentary elevation partly in cross-section of the skate boot.

The boot 16 includes a lower 18, an intermediate portion 20 and an upper 22. The lower is a one piece molded shell formed, utilizing conventional molding techniques presently used in molded plastic skate boots. The shell forming the lower 18 includes a toe zone 24, a metatarsal zone 26 and a heel zone 28. An opening or slot is defined by edges 30 and 32, extends from the toe zone 24 through the metatarsal zone and is provided to receive the eyelet bands as will be described later. The lower 18 also includes a sole 29 which of course, is formed as part of the shell making up the lower 18. The sole 29 in the zone 24 can be built up as shown in FIG. 5 in order to provide a more direct transfer of forces from the toes of the skater to the blade. The lower 18 includes upstanding edges 34 and 36 as seen in FIG. 4, adapted to receive the intermediate portion 20 as will be described. The rear of the heel zone 28 of the lower 18 includes an upstanding tab 31 which forms part of the protection for the Achilles tendon.

Figure 9:
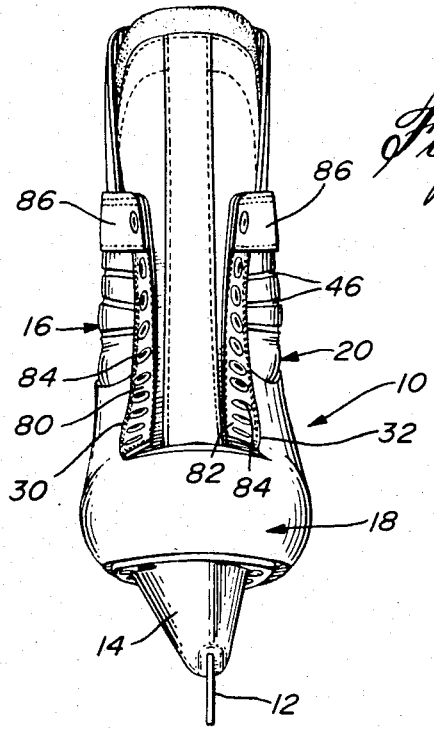
FIG. 9 is a front elevation thereof.
Figure 10:
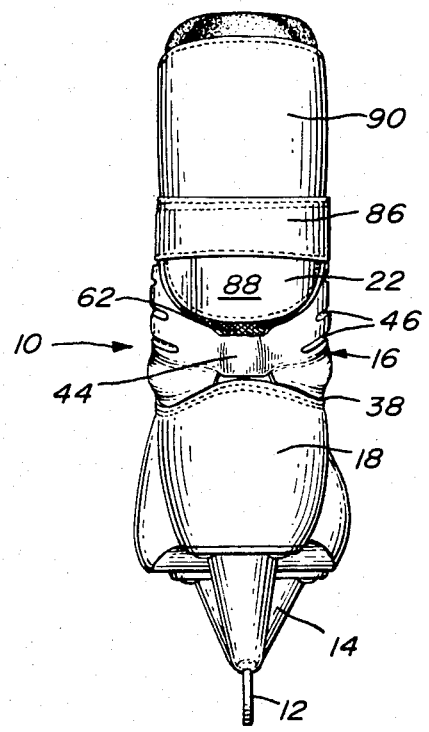
FIG. 10 is a rear elevation thereof.

The shell forming the lower 18 has a wall thickness in the toe zone 24 and the heel zone 28 as well as at the sole 29 such as to provide substantial rigidity and protection against impacts which may occur during the game of hockey such as, the reception of a hard hockey puck travelling at speeds in excess of 150 kilometers and hour or the sudden impact of a hockey stick or someone else's skate blade. The blade support 14 can be riveted to the sole 29 forming part of the lower 18. The sole 29 is sufficiently rigid to provide lateral stability to the blade support 14. The lower has an inverted trapezoidal shape, as shown in FIGS. 9 and 10, in order to allow a greater degree of banking in turns.

The intermediate member 20 is molded having a U-shaped horizontal cross-section and is made of a softer material then the plastic material utilized for the lower 18. The intermediate member 20 or ankle portion may have a bellow or corrugated construction in the sidewall thereof as illustrated by the bellows grooves 46. The intermediate member 20 also has lower side edges 50 which are adapted to overlap with the upstanding edges 34 and 36 on the lower. Seam 38 connects the overlapping edges on the sidewalls thereof but it is noted that the intermediate member 20 is not fixed to the lower 18 in the rear or Achilles tendon area. Rather, a lip 44 extends downwardly and overlaps freely with the upstanding rear portion 31 of the lower 18. This construction allows forward flexion of the boot. Grooves 46 are formed in the sidewalls of the intermediate member to provide flexibility for lateral flexibility in the ankle area of the boot and conformity to the ankle area of the foot. A bellows 54 is formed in both sidewalls of the intermediate member 20 below the grooves 46. The bellows is an arcuate bowed out portion thereof of thinner material. This allows for forward flexion lateral and torsional flexibility. The intermediate member 20 includes forwardly extending tabs or edges 58 shown in dotted lines in FIG. 4, for instance. An upwardly extending tab 52 is provided on both sides as shown in dotted lines in FIG. 4. The intermediate member 20 is made of a polyester based polyurethane having good memory.

An underlying nylon fabric sheet 62 is fixedly connected by stitching to the lower edge 50 of the intermediate member 20 along seam 38 and to the upper tab or edge 52. The nylon fabric sheet 62 is flexible but it has a high resistance to stretch when tension forces are applied thereto. The sheet enables the intermediate member 20 to flex laterally but prevents it from becoming elongated or from otherwise stretching.

Figure 6:
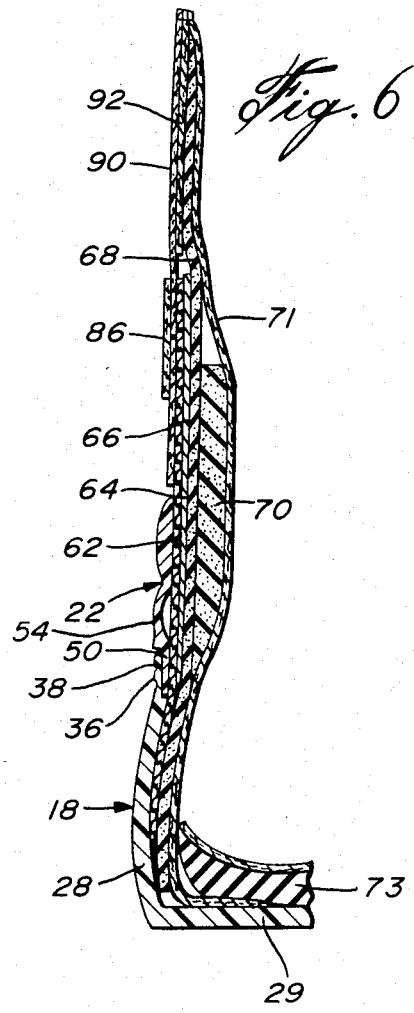
FIG. 6 is a vertical cross-section taken along lines VI—VI of FIG. 3.
Figure 7:
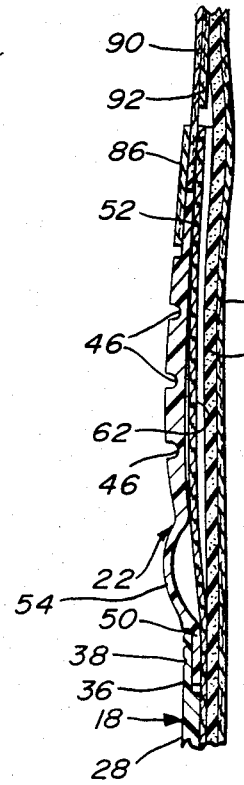
FIG. 7 is a vertical cross-section taken along lines VII—VII of FIG. 3.
Figure 8:
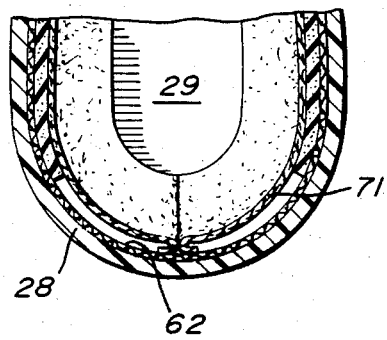
FIG. 8 is a horizontal cross-section taken along lines VIII—VIII of FIG. 3.

Although only one side of the skate construction is illustrated in FIGS. 6 and 7, both sides of the skate are identical in construction. Accordingly, in describing the side of the intermediate member 20 in FIGS. 6 and 7, the same elements are provided in the other side of the intermediate member 20.

The intermediate member 20 is cut out in the Achilles tendon area and provides merely the height of the lip 44. The area within the boot behind the lip 44 is protected by the nylon fabric sheet 62. The intermediate member 20 is of a softer material than the lower and may be made of a polyurethane elastomer. Its construction is such as to provide a "prebroken" skate boot. The term is derived from the conventional leather skate. It is necessary when a new pair of leather skates are being "broken in" that the stiffness of the leather in the area of the ankle be made somewhat softer by repeated use so as to give the necessary flexibility but not to be soft to the point where the skate becomes useless. With the present intermediate member, the proper degree of breaking-in or flexibility is provided in the area of the ankle. The forward flexure is provided by the construction of the intermediate member 20 in the area of the Achilles tendon as previously described with respect to the upstanding edge 31 and the lip 44 which overlap but which are not directly connected. Further, as will be described, a similar provision is made between the intermediate member and the rear portion of the upper 22.

The upper 22 is made of leather or leather-like and includes a pair of eyelet bands 80 and 82 extending within the slot defined by edges 30 and 32 furnished in the lower 18 for this purpose. The eyelet bands 80 and 82 are connected by stitching to the edges 30 and 32 of the lower 18. Each eyelet band 80 and 82 is furnished with eyelets 84. The eyelet bands 80 and 82 are also stitched to the forwardly extending tabs 58 on the intermediate member 20.

The upper 22 also includes a horizontally extending U-shaped leather collar band attached to the upper tab 52 of the intermediate member 20 and has a downwardly extending Achilles tendon back 88, which is shaped to the form of the cut out in the rear of the intermediate member 20. The Achilles tendon back portion 88 is stitched to the horizontal band 86 but is not stitched to the intermediate member. Rather, the back 88 is underlaid by the nylon fabric sheet 62 which itself is stitched to the leather band 86. Finally, the leather upper is provided with a tendon guard 90 of conventional construction which is an upward extension of the leather back 88.

A liner is fixed within the so-formed boot 16. The liner includes a laminated stiffener 92 in the area of the tendon guard 90 as shown in FIG. 6 and a soft leather inlay 66 in the area of the intermediate member 20. The nylon sheet 62 can have a thin layer of cotton fabric 54 laminated thereto. Overlying the above mentioned inlays is a foam material layer 68 which extends from the top of the tendon guard to the sole. A thick E.V.A. thermo plastic heat formable foam pad 70 is provided in the area of the ankles. This material has the property of forming under body heat and is meant to block the boot against the ankles. Finally, a smooth soft conventional inner liner usually made of leather is provided and is identified by the numeral 71. The leather liner 71 is made in the form of the inner shape of the boot and is glued thereto while the above mentioned liner such as the foam liners 68 and nylon fabric 62 are only provided in the area of the ankles and heel but do not extend into the Achilles tendon area or the forward portion of the boot ie., the metatarsal zone or the toe zone. A foot bed 73 may also be provided in the bottom of the boot.

The tongue 102 is fixed to the toe zone 24 of the lower 18 by means of a rivet 106. The tongue 102 is constructed of leather with a felt liner. A plastic cap 104 forms the leading portion of the tongue 102 and is the portion which is connected by the rivet 106. The upper surface of the toe zone 24 is provided with a lateral rib and woodruff key type abutments 108 and 110 while the plastic tab 104 has mating abutments 116 and 117 which allow the tongue 102 to be locked against rearward movement thereof without providing undue force on the rivet 106. The shape of the abutments also allows the tongue to be easily lifted to allow the foot to be inserted or removed from the boot. These abutments come into play only when the tongue is subjected to a tension force rearwardly thereof. The cap 104 adds further impact protection to that area of the foot between the toes and the metatarses.

In constructing the skate boot 16, the lower 18 is first injection molded in one piece as shown in FIG. 4 for instance. The intermediate member 20 is formed separately and the upper is sewn along the sidewalls to tabs 52 of the intermediate member 20. The inner layers are assembled together and then sewn to the so-formed intermediate and upper. The assembly is then inserted with glue to the lower 18 and the seams 38 are formed. The tongue is mounted by means of riveting. Similarly, the blade is attached to the sole of the boot by rivets which can be utilized to hold down the foot bed 73.

I claim:

1. A skate boot including a lower, an upper and an intermediate portion between the lower and the upper; the lower including a sole, a toe and heel portion of the boot and being made of a molded, unitary, rigid plastics material; the intermediate portion being connected on either side thereof to the lower and including ankle and Achilles tendon portions of the boot, the intermediate portion being made of a relatively flexible material; the upper including a collar and an upper tendon guard, the upper being connected to upper edge portions of the intermediate portion, the upper being made of a pliable material.

2. A skate boot as defined in claim 1, wherein the skate boot is utilized for an ice hockey skate and the intermediate portion is connected to the lower along the sides thereof while the Achilles tendon portion of the intermediate portion is unconnected to the lower but overlaps with an upwardly extending portion of the lower.

3. A skate boot as defined in claim 1, wherein the upper includes a pair of eyelet bands provided in a slot defined in the lower and fixedly connected to the respective edges of the lower defining the slot, the intermediate portion including forwardly extending tabs to which the eyelet bands are further connected.

4. A skate boot as defined in claim 1, wherein the upper is made of pliable leather material and includes a collar band connected along the sides thereof to the intermediate portion and includes a downwardly extending Achilles guard complementary to the Achilles tendon portion of the intermediate portion and an upwardly extending tendon guard.

5. A skate boot as defined in claim 1, wherein an inner liner of flexible stretch resistant material is connected to the lower and to the upper along the margins of the intermediate portion so as to allow the intermediate portion to flex forwardly and laterally but to prevent elongation of the intermediate portion.

6. A skate boot as defined in claims 1 or 2, wherein the intermediate portion has grooves in either side thereof to enhance the flexibility of the skate boot in the ankle area and said intermediate portion is made of a relatively softer molded plastics material than the material utilized for the lower such that the intermediate portion is relatively flexible compared to the lower while the upper including the eyelet bands is of a pliable leather material such as to take the form of the foot through repeated use.

7. A skate boot as defined in claim 1, wherein a stretch-resistant flexible liner extends within the boot and is attached to the lower and upper portions of the intermediate portion and underlies the the remainder of intermediate portion such as to allow lateral flexibility of the relatively flexible intermediate portion but to prevent elongation of the intermediate portion.

8. A skate boot having a lower, an ankle portion and an upper;

the lower being made of a unitary molded rigid plastics material defining a sole and an enclosed toe zone, a metatarsal zone and a heel zone and an elongated opening in the metatarsal zone;

the ankle portion including a unitary member of relatively flexible material adapted to extend over the ankle protrusions and part of the Achilles tendon of the wearer, the ankle portion being attached to the lower along the sides thereof;

the upper being made of leather or leather-like material and defining a guard covering a portion of the Achilles tendon, an eyelet band on either side of the elongated opening in the lower;

the upper being attached to the ankle portion and the eyelet bands of the upper being connected to the lower respectively;

an interior liner being provided with the boot is attached at least to the lower and the upper such that the liner extends within the boot over the ankle portion whereby the skate is provided with improved rigidity and wear resistance in the lower, combined with lateral flexibility in the ankle area and formability in the eyelet bands and upper.

9. A skate boot as defined in claim 8, wherein the ankle portion is underlaid by a stretch resistant flexible sheet connected to the lower and to the upper marginal areas of the ankle portion such as to allow lateral flexibility to the boot but to prevent elongation of the ankle portion.

10. A skate boot as defined in claim 9, wherein the stretch resistant liner includes a nylon woven fabric stitched to the lower and to the upper and underlying the intermediate or ankle portion.

11. A skate boot as defined in claim 7, wherein the Achilles tendon area includes a portion of the lower in the heel zone including an upstanding member extending over a portion of the Achilles tendon of the wearer, the ankle portion having a protective section thereof overlapping the upward extension of the lower but unconnected thereto and the upper having a downwardly extending back complementing the top edge of the Achilles tendon portion of the ankle portion such as to provide forward flexibility of the skate boot.

12. A method of forming a skate boot comprising the steps of molding from plastics material, a lower of unitary construction defining the sole, toe, metatarsal and heel of the boot provided with an upstanding continuous edge defining in part an opening for receiving eyelet bands and an ankle portion; molding an ankle portion of relatively flexible plastics material; fixing an upper including eyelet bands to the respective upper edges of the ankle portion at least on the sides thereof; forming an inner liner and fixing the inner liner to the upper and ankle portion, inserting the so-formed assembly into the lower and fixing the ankle portion along its sides to the upstanding edge of the lower and otherwise fixing the inner liner as well as the eyelet bands of the upper to the lower, and fixing the inner liner to at least the upper and lower portions of the boot.

* * * * *